US009326642B1

(12) United States Patent
Williams

(10) Patent No.: US 9,326,642 B1
(45) Date of Patent: May 3, 2016

(54) SOAP DISPENSING SCRUB BRUSH FOR THE BACK

(71) Applicant: Randeen Williams, Norcoss, GA (US)

(72) Inventor: Randeen Williams, Norcoss, GA (US)

( * ) Notice: Subject to any disclaimer, the term of this patent is extended or adjusted under 35 U.S.C. 154(b) by 0 days.

(21) Appl. No.: 14/247,554

(22) Filed: Apr. 8, 2014

(51) Int. Cl.
*A46B 11/00* (2006.01)
*A47K 7/03* (2006.01)
*A47K 7/02* (2006.01)

(52) U.S. Cl.
CPC ..... *A47K 7/022* (2013.01); *A46B 11/0013* (2013.01); *A47K 7/028* (2013.01); *A47K 7/03* (2013.01)

(58) Field of Classification Search
CPC .. A46B 11/00; A46B 11/001; A46B 11/0013; A47K 7/022; A47K 7/03
USPC ..... 401/268, 291, 286, 287
See application file for complete search history.

(56) References Cited

U.S. PATENT DOCUMENTS

| | | | | |
|---|---|---|---|---|
| 738,455 | A * | 9/1903 | King | 401/273 |
| 1,165,208 | A * | 12/1915 | Ricard | 401/278 |
| 2,920,333 | A * | 1/1960 | Montague et al. | 401/22 |
| 4,826,340 | A * | 5/1989 | Rothweiler et al. | 401/279 |
| 4,964,398 | A | 10/1990 | Jones | |
| D313,123 | S | 12/1990 | Hayes | |
| 6,170,108 | B1 | 1/2001 | Knight | |
| 6,439,790 | B1 * | 8/2002 | Kay | 401/149 |
| 6,687,924 | B2 | 2/2004 | Wright | |
| 7,503,715 | B2 | 3/2009 | Khubani | |
| 8,088,085 | B2 | 1/2012 | Thiebaut | |
| 2005/0201811 | A1 * | 9/2005 | Russell et al. | 401/6 |
| 2009/0092435 | A1 * | 4/2009 | Stevens | 401/6 |
| 2011/0135380 | A1 * | 6/2011 | Wales | 401/276 |

* cited by examiner

*Primary Examiner* — Mark A Laurenzi
*Assistant Examiner* — Joshua Wiljanen

(57) ABSTRACT

The handheld scrubbing assembly for selectively dispensing a detergent includes a reservoir that may contain a detergent. A brush is operationally coupled to the reservoir. The detergent is dispensed onto the brush. A tubular handle is operationally coupled to the reservoir. The tubular handle may be gripped. A cap is operationally coupled to the tubular handle. The cap is removed so the detergent is poured into the tubular handle. The detergent is stored in the reservoir.

7 Claims, 3 Drawing Sheets

SOAP DISPENSING SCRUB BRUSH FOR THE BACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of scrubbing systems, more specifically, soap dispensing scrub brush for the backs.

SUMMARY OF THE INVENTION

An embodiment of the disclosure meets the needs presented above by generally comprising a reservoir that may contain a detergent. A brush is operationally coupled to the reservoir. The detergent is dispensed onto the brush. A tubular handle is operationally coupled to the reservoir. The tubular handle may be gripped. A cap is operationally coupled to the tubular handle. The cap is removed so the detergent is poured into the tubular handle. The detergent is stored in the reservoir.

An object of the invention is to provide a device that is soap dispensing scrub brush for the back.

These together with additional objects, features and advantages of the soap dispensing scrub brush for the back will be readily apparent to those of ordinary skill in the art upon reading the following detailed description of presently preferred, but nonetheless illustrative, embodiments of the soap dispensing scrub brush for the back when taken in conjunction with the accompanying drawings.

In this respect, before explaining the current embodiments of the soap dispensing scrub brush for the back in detail, it is to be understood that the soap dispensing scrub brush for the back is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the soap dispensing scrub brush for the back.

It is therefore important that the claims be regarded as including such equivalent construction insofar as they do not depart from the spirit and scope of the soap dispensing scrub brush for the back. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
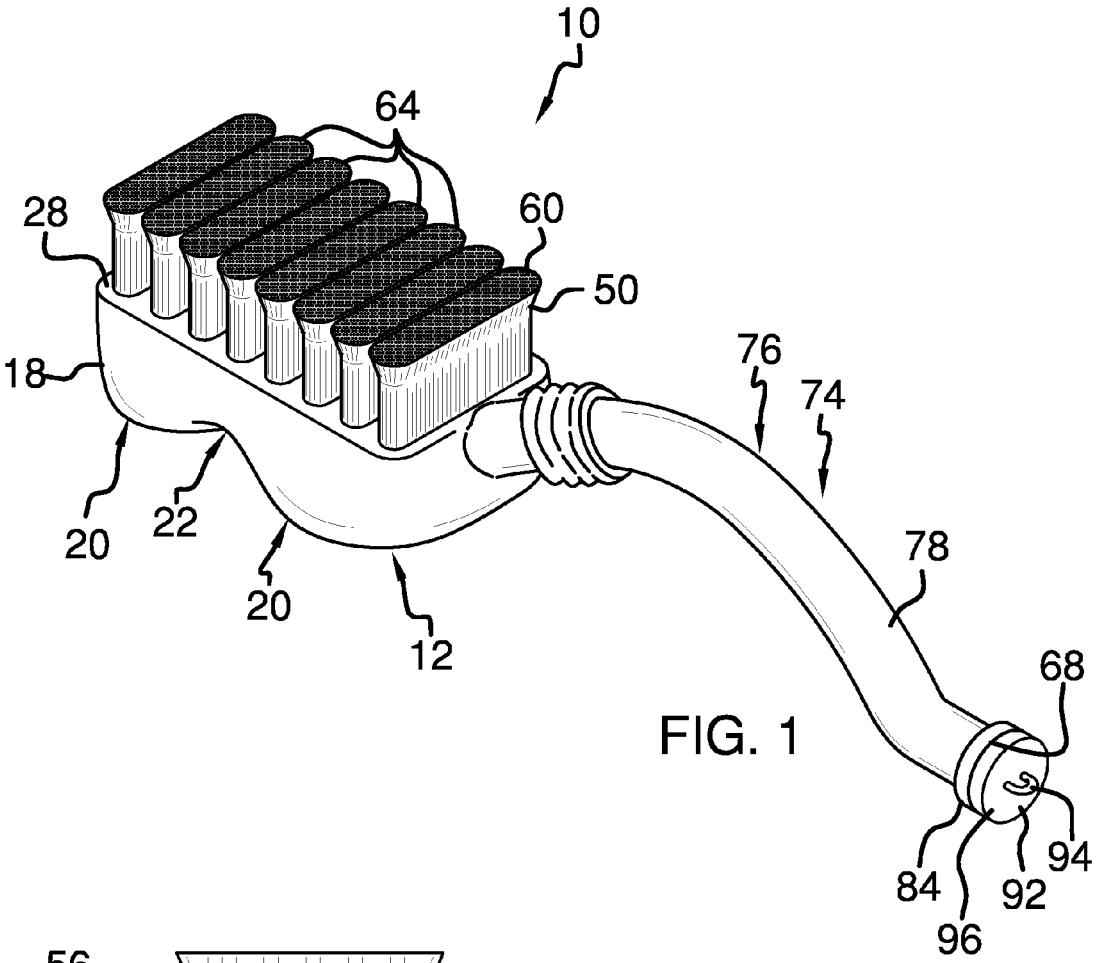
FIG. 1 is a top perspective view of a handheld scrubbing assembly according to an embodiment of the disclosure.
Figure 2:
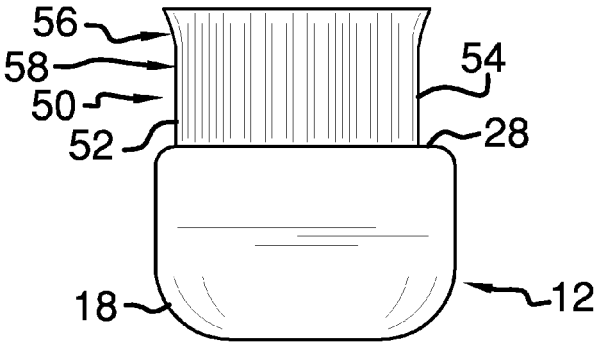
FIG. 2 is a front view of an embodiment of the disclosure.
Figure 3:
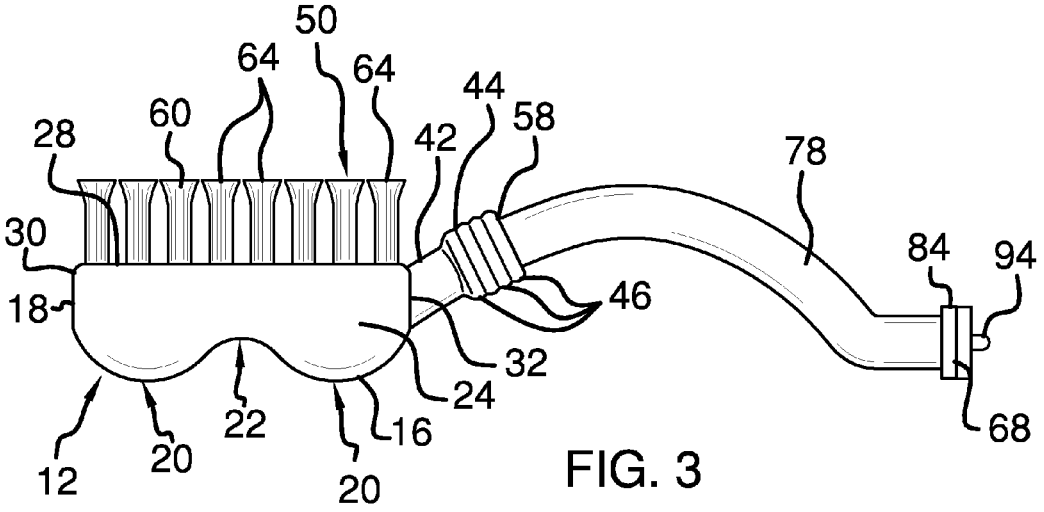
FIG. 3 is a left side view of an embodiment of the disclosure.
Figure 4:
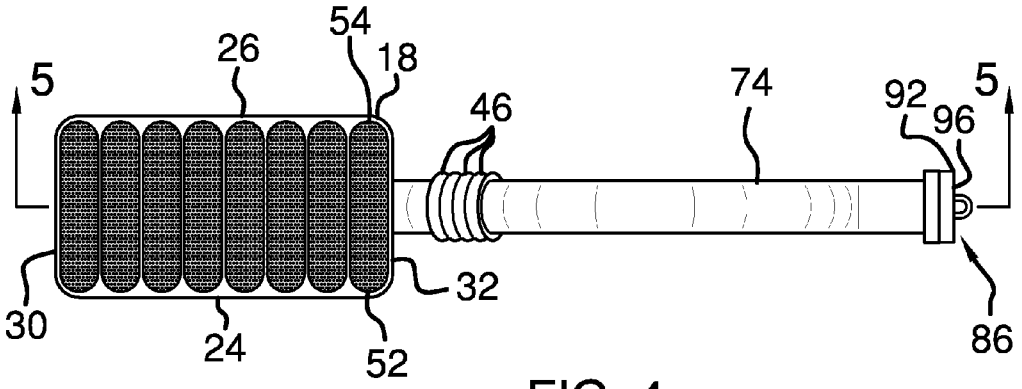
FIG. 4 is a top view of an embodiment of the disclosure.
Figure 5:
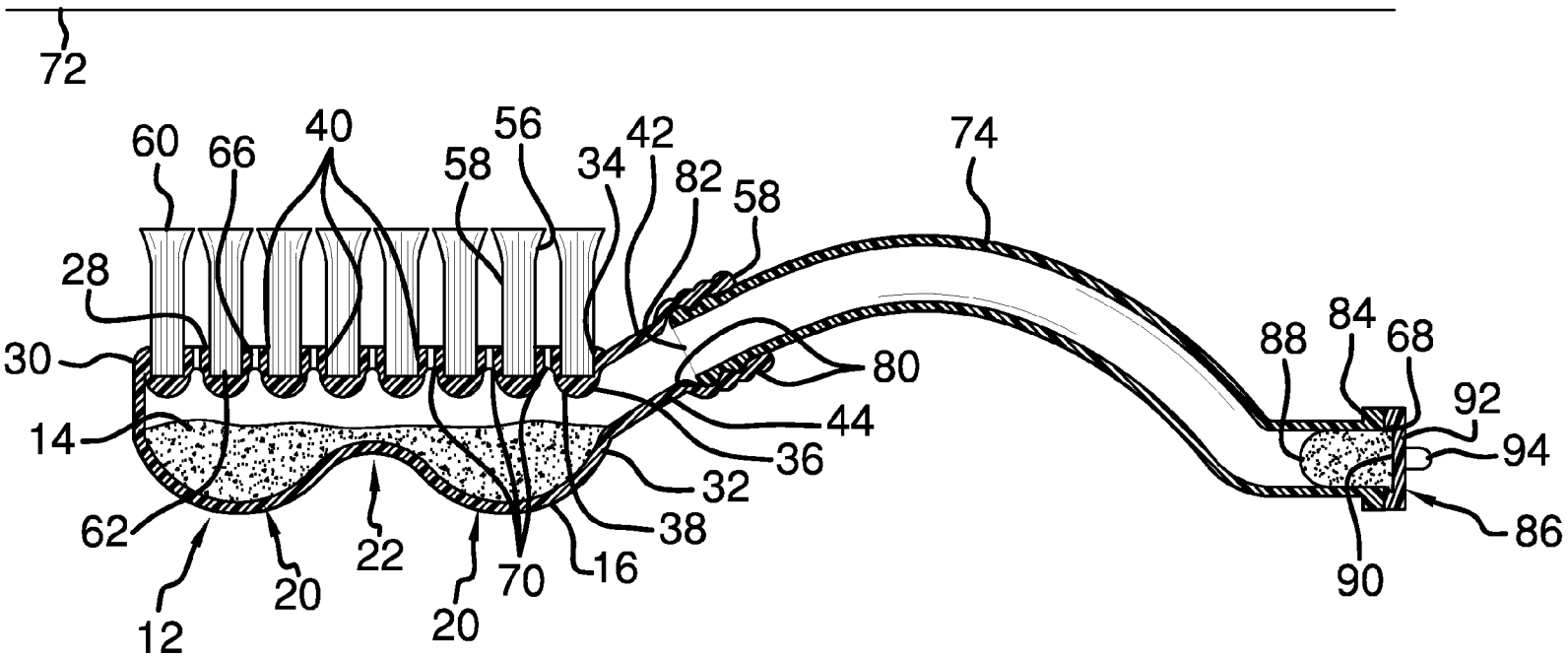
FIG. 5 is a cross sectional view taken along line 5-5 of FIG. 4.

As best illustrated in FIGS. 1 through 5, the handheld scrubbing assembly 10 generally comprises a reservoir 12 that may contain a detergent 14. The detergent 14 may comprise a liquid soap of any conventional design. Continuing, a bottom side 16 of an outer wall 18 of the reservoir 12 is curved. The bottom side 16 of the outer wall 18 of the reservoir 12 comprises a pair of undulating prominences 20. Moreover, a valley 22 is positioned between the pair of undulating prominences 20.

The pair of undulating prominences 20 and the valley 22 each extends between a first lateral side 24 and a second lateral side 26 of the outer wall 18 of the reservoir 12. A top side 28 of the outer wall 18 of the reservoir 12 is flat. Moreover, the reservoir 12 has a quonset-like cross section taken along a longitudinal axis extending through a front side 30 and a back side 32 of the outer wall 18 of the reservoir 12. The reservoir 12 may have a length between 10 cm and 13 cm and a height and a width between 5 cm and 7 cm.

A brush well 34 extends downwardly into the top side 28 of the outer wall 18 of the reservoir 12. The brush well 34 extends between the first lateral side 24 and the second lateral side 26 of the outer wall 18 of the reservoir 12. An bottom surface 36 of a bottom wall 38 of the brush well 34 is curved. Additionally, the brush well 34 may have a depth between 3 mm and 6 mm. The brush well 34 is one of a plurality of brush wells 40 that are evenly distributed between the front side 30 and the back side 32 of the outer wall 18 of the reservoir 12.

A fill tube 42 is fluidly coupled to the back side 32 of the outer wall 18 of the reservoir 12. The fill tube 42 is positioned proximate the top side 28 of the outer wall 18 of the reservoir 12. Moreover, the fill tube 42 angles upwardly from the back side 32 of the outer wall 18 of the reservoir 12. An outer wall 44 of the fill tube 42 comprises a plurality of undulating rings 46 extending laterally around the fill tube 42. The plurality of undulating rings 46 are positioned proximate a free end 48 of the fill tube 42.

A brush 50 is elongated along a longitudinal axis extending through a first lateral end 52 and a second lateral end 54 of the brush 50. The brush 50 may have a length between 4 cm and 6 cm. Additionally, a top portion 56 of the brush 50 is flared outwardly from a lower portion 58 of the brush 50. The top portion 56 of the brush 50 has a frusto-conical cross section taken along the longitudinal axis extending through the first lateral end 52 and the second lateral end 54 of the brush 50.

The lower portion 58 of the brush 50 may have a width between 3 mm and 6 mm and a height between 4 cm and 5 cm. Additionally, the top portion 56 of the brush 50 may have a height between 1 cm and 2 cm. Moreover, a top end 60 of the brush 50 may have a width between 1 cm and 2 cm. A bottom end 62 of the brush 60 is positioned within the brush well 34 so the brush 50 is retained in the brush well 34.

The brush 50 is one of a plurality of the brushes 64. Each of the plurality of brushes 64 is positioned within an associated one of the plurality of brush wells 40. A detergent aperture 66 extends through the top side 28 of the outer wall 18 of the reservoir 12. The detergent aperture 66 is one of a plurality of detergent apertures 70. Lastly, the plurality of detergent apertures 70 is distributed between each of an associated one of the plurality of brushes 64.

The detergent 14 exits the plurality of detergent apertures 70. Continuing, the detergent 14 is distributed to each of the plurality of brushes 64. Lastly, the detergent 14 aids the plurality of brushes 64 in cleaning a surface 72.

A tubular handle 74 is provided. Continuing, a forward portion 76 of the tubular handle 74 is curved. The tubular handle 74 has a scythe shape so the tubular handle 74 may be gripped. An outer wall 78 of the tubular handle 74 comprises a plurality of undulating rings 80 extending around the tubular handle 74. The plurality of undulating rings 80 is positioned proximate an open first end 82 of the tubular handle 74.

The open first end 82 of the tubular handle 74 is rotatably coupled to the free end 48 of the fill tube 42. Additionally, the plurality of undulating rings 80 on the tubular handle 74 engages the plurality of undulating rings 80 on the fill tube 42. The tubular handle 74 is retained on the fill tube 42. Finally, the tubular handle 74 is in fluid communication with the reservoir 12.

A lip 84 is coupled to and extends outwardly from the outer wall 78 of the tubular handle 74. The lip 84 is coextensive with an open second end 68 of the tubular handle 74. Finally, the lip 84 may extend away from the tubular handle 74 a distance between 3 mm and 6 mm.

A cap 86 is provided. Continuing, a plug portion 88 of the cap 86 is coupled to and extends away from a bottom side 90 of a cover portion 92 of the cap 86. The plug portion 88 of the cap 86 is selectively inertably positionable within the open second end 68 of the tubular handle 74. Moreover, the bottom side 90 of the cover portion 92 of the cap 86 covers the lip 84.

A hoop 94 is coupled to a top side 96 of the cover portion 92 of the cap 86. The cap 86 is selectively removable from the open second end 86 of the tubular handle 74. Moreover, the detergent 14 is poured into the tubular handle 74. The tubular handle 74 directs the detergent 14 into the reservoir 12.

In use, the reservoir 12 is filled with the detergent 14. The plurality of brushes 64 are used to abrade the surface 72. Continuing, the detergent 14 runs along the plurality of brushes 64 so the detergent 14 is applied to the surface 72. Moreover, the reservoir 12 is re-filled with the detergent 14 when the reservoir 12 becomes empty. Lastly, the reservoir 12 is used in either a wet or a dry environment.

With respect to the above description, it is to be realized that the optimum dimensional relationship for the various components of the handheld scrubbing assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the handheld scrubbing assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A handheld scrubbing assembly for selectively dispensing a detergent, said assembly comprising:
- a reservoir configured to contain the detergent;
- a brush is coupled to said reservoir;
- wherein the detergent is dispensed onto said brush;
- a tubular handle is coupled to said reservoir;
- wherein said tubular handle is configured to be gripped;
- a cap is coupled to said tubular handle, said cap being removed;
- wherein the detergent is poured into said tubular handle;
- wherein the detergent is stored in said reservoir;
- wherein a bottom side of an outer wall of said reservoir is curved;
- wherein said bottom side of said outer wall of said reservoir comprises a pair of undulating prominences and a valley between said pair of undulating prominences;
- wherein said pair of undulating prominences and said valley each extend between a first lateral side and a second lateral side of said outer wall of said reservoir;
- wherein a top side of an outer wall of said reservoir is flat;
- wherein said reservoir has a quonset-like cross section taken along a longitudinal axis that extends through a front side and a back side of said outer wall of said reservoir;
- wherein said brush is one of a plurality of said brushes each positioned within an associated one of a plurality of brush wells;
- wherein a forward portion of said tubular handle is curved;
- wherein said tubular handle has a scythe shape;
- wherein an open first end of said tubular handle is rotatably coupled to a free end of a fill tube;
- wherein said tubular handle is in fluid communication with said reservoir;
- wherein said cap is removably coupled to an open second end of said tubular handle;
- wherein a brush well extends downwardly into a top side of an outer wall of said reservoir;
- wherein said brush well extends between a first lateral side and a second lateral side of said outer wall of said reservoir;
- wherein said brush well is one of a plurality of brush wells being evenly distributed between a front side and a back side of an outer wall of said reservoir.

2. The assembly according to claim 1 wherein a fill tube fluidly coupled to a back side of an outer wall of said reservoir proximate a top side of said outer wall of said reservoir.

3. The assembly according to claim 2 wherein said fill tube is angled upwardly from said back side of said outer wall of said reservoir.

4. The assembly according to claim 1 wherein said brush is elongated along a longitudinal axis that extends through a first lateral end and a second lateral end of said brush.

5. The assembly according to claim 1 wherein a top portion of said brush being flared outwardly from a lower portion of said brush; wherein said top portion of said brush has a frusto-conical cross section taken along a longitudinal axis that extends through a first lateral end and a second lateral end of said brush.

6. The assembly according to claim 1 wherein a bottom end of said brush is positioned within a brush well.

7. A handheld scrubbing assembly for selectively dispensing a detergent, said assembly comprising:

a reservoir configured to contain the detergent;

a brush is coupled to said reservoir;

wherein the detergent is dispensed onto said brush;

a tubular handle is coupled to said reservoir;

wherein said tubular handle is configured to be gripped;

a cap is coupled to said tubular handle, said cap being removed;

wherein the detergent is poured into said tubular handle;

wherein the detergent is stored in said reservoir;

wherein a bottom side of an outer wall of said reservoir is curved;

wherein said bottom side of said outer wall of said reservoir comprises a pair of undulating prominences and a valley between said pair of undulating prominences;

said pair of undulating prominences and said valley each extend between a first lateral side and a second lateral side of said outer wall of said reservoir;

a top side of said outer wall of said reservoir being flat;

wherein said reservoir has a quonset-like cross section taken along a longitudinal axis that extend through a front side and a back side of said outer wall of said reservoir;

wherein a brush well extend downwardly into a top side of an outer wall of said reservoir;

wherein said brush well extends between a first lateral side and a second lateral side of said outer wall of said reservoir;

said brush well is one of a plurality of brush wells that are distributed between a front side and a back side of said outer wall of said reservoir;

a fill tube fluidly coupled to said back side of said outer wall of said reservoir proximate said top side of said outer wall of said reservoir; said fill tube is angled upwardly from said back side of said outer wall of said reservoir;

wherein said brush is elongated along a longitudinal axis that extends through a first lateral end and a second lateral end of said brush;

a top portion of said brush is flared outwardly from a lower portion of said brush;

wherein said top portion of said brush has a frusto-conical cross section taken along a longitudinal axis that extends through said first lateral end and said second lateral end of said brush;

a bottom end of said brush is positioned within a brush well;

said brush is one of a plurality of brushes each positioned within an associated one of a plurality of brush wells;

wherein a forward portion of said tubular handle is curved;

wherein said tubular handle has a scythe shape;

an open first end of said tubular handle is rotatably coupled to a free end of a fill tube;

wherein said tubular handle is in fluid communication with said reservoir; said cap being removably coupled to an open second end of said tubular handle.

* * * * *